US005782452A

United States Patent [19]

Bosworth

[11] Patent Number: 5,782,452

[45] Date of Patent: Jul. 21, 1998

[54] COMBINATION PICTURE POST CARD MAILER AND DISPLAY EASEL

[76] Inventor: John Bosworth, 601 N. Broadway, Upper Nyack, N.Y. 10960

[21] Appl. No.: 645,083

[22] Filed: May 13, 1996

[51] Int. Cl.[6] ..... A47B 97/04

[52] U.S. Cl. ..... 248/459; 248/174; 40/750; 229/313

[58] Field of Search ..... 248/459, 174; 40/750, 751, 124.16; 206/45.21, 45.22, 45.23, 45.24, 45.25, 45.26, 45.27, 767, 768; 229/313, 92.8; D19/1

[56] References Cited

U.S. PATENT DOCUMENTS

| | | | |
|---|---|---|---|
| 871,833 | 11/1907 | Taylor . | |
| 1,090,142 | 3/1914 | Fischer | 248/174 |
| 1,207,577 | 12/1916 | Loose . | |
| 1,486,652 | 3/1924 | Froelich | 248/459 X |
| 1,767,753 | 6/1930 | Frieberg . | |
| 1,890,258 | 12/1932 | Hinson . | |
| 2,383,776 | 8/1945 | Cross . | |
| 3,164,350 | 1/1965 | Taub | 248/174 |
| 3,275,281 | 9/1966 | Sampson | 248/174 X |
| 3,473,777 | 10/1969 | Ketterer | 40/750 X |
| 3,758,065 | 9/1973 | Ranseen . | |
| 4,167,241 | 9/1979 | Zumbrunn | 40/750 X |
| 5,361,521 | 11/1994 | Burtch | 40/750 |
| 5,645,214 | 7/1997 | Taganas | 229/313 |
| 5,678,756 | 10/1997 | Sugiura | 40/750 X |

*Primary Examiner*—Ramon O. Ramirez
*Assistant Examiner*—Long Dinh Phan
*Attorney, Agent, or Firm*—H. Gibner Lehmann; K. Gibner Lehmann

[57] ABSTRACT

A combination post card mailer and display easel formed from a die-cut blank. The card and easel have an easel portion, an address and message portion, and a display portion, the latter typically containing an attractive color photo. The address and message portion is separably attached to the display portion. The easel portion is foldable over the display portion, and the address and message portion is in turn foldable over the superposed easel portion and separably held thereon. The arrangement is such that the consumer can purchase the post card in a flat, folded condition which largely resembles the configuration of a conventional post card, but which has provision for enabling the recipient to easily tear off the message and address portion and retain the decorative display portion and attached easel portion. The latter in turn can be folded along pre-creased fold lines, to form a stand. The display portion, typically containing the color photo, can thus be supported in an upright position on a desk or table, for subsequent viewing as a memento, decoration, or ornament.

31 Claims, 4 Drawing Sheets

COMBINATION PICTURE POST CARD MAILER AND DISPLAY EASEL

BACKGROUND OF THE INVENTION

1. Field of the Invention

This invention relates generally to decorative post cards, and more particularly to displays associated with such cards, for supporting them in the manner of an ornamental or decorative table article.

DESCRIPTION OF THE RELATED ART INCLUDING INFORMATION DISCLOSED UNDER 37 CFR Sections 1.97–1.99

The following patents are hereby cited as being of interest in the field to which the present invention pertains:

U.S. Pat. Nos.:

871,833 1,207,577 1,767,753

1,890,258 2,383,776 3,473,777

3,758,065

British Patent No. 113,330

Considering the patents in chronological order, U.S. Pat. No. 871,833 relates to an easel attachment for a display card, wherein scored side panels of the easel can be folded outwardly and secured in coextensive relation by means of tab/slot fastener structures. The card to be supported is constituted as a piece separate from the easel, and the two are glued together, to form the composite display article.

U.S. Pat. No. 1,207,577 discloses an inclined support structure on a display box, wherein the support, prior to assembly, has a flattened configuration so as to reduce the overall size and bulk of the box, for storage and/or shipping. The support consists of multiple panels that can be unfolded into a semi-rigid, wedge-shaped base, upon which the box rests in order that the contents can be readily seen from one side thereof.

U.S. Pat. No. 1,767,753 relates to an easel construction adapted to be glued to an article to be displayed, such as a picture or sign. The easel features adjustability as to the angle of support, by means of supplemental score lines "b". These enable the easel panels to fold in the manner of a bellows, allowing expansion of the lower edge portions of the easel and thus varying the incline of the article being supported.

U.S. Pat. No. 1,890,258 relates to a display device for advertisements, comprising a sign portion and a pedestal portion. The two portions are secured by suitable adhesive. The combined sign and pedestal can be folded into a flat configuration as needed, for storage or shipping.

U.S. Pat. No. 2,383,776 discloses a multi-part easel construction, having a back board (10) with integrally formed easel panels, a face board (12) superposed thereon, and an optional frame member (14) overlying the face board. The easel can be folded between flat and extended positions. Several different arrangements for holding the easel panels in desired, extended positions are shown.

A one-piece easel/display panel is illustrated in U.S. Pat. No. 3,473,777. The panel is die-cut from a single sheet of paper or cardboard. The display portion of the panel is covered by a transparent laminated sheet (11), which protects the surface of the panel face. The display is intended for use as a picture frame U.S. Pat. No. 3,758,065 relates to an easel for supporting cards, posters, or tags. The easel per se, is constituted as cut-out or blank, formed from a sheet of cardboard or paper board.

British Patent No. 113,330, FIGS. 1 and 2, disclose an easel utilizing a stud fasteners. The resulting structure comprises essentially a triangular pyramid. FIGS. 14–16 show a combined easel support and picture frame, for supporting articles such as photos or display cards.

It appears that the devices noted above have not enjoyed commercial success to any significant extent. One possible explanation is the apparent disassociation between the support mechanisms that have been described and the specific articles that are intended to be displayed. Also, in the case of picture post cards there does not appear to exist in the prior art, a truly simple, integrally formed support mechanism of a type which accompanies the card during shipping to the retail outlet, or during storage, sale, and ultimate purchase by a tourist, for example, for mailing to a friend or relative.

Also, consumers are not likely, when purchasing a post card, to be overly concerned with its ultimate disposition. Instead, the purchaser's main interest is in buying the card, writing a message, and having the card and attached message delivered to the recipient in a timely manner.

SUMMARY OF THE INVENTION

Accordingly there has existed a long-felt need for a combined mailer-and-display holder which remain with one another at all times, such that the recipient, upon receiving the post card, automatically has in hand, a supporting easel structure that he can utilize to display the card on a desk or table, as desired, and with a minimum of time and effort expended in figuring out what to do with the card after it is initially read or examined.

Accordingly, the present invention obviates the problem of conveniently and inexpensively displaying a decorative post card on a desk or table, for subsequent viewing. Thus an object of the invention is to provide a novel and improved combined post card mailer and integrally-attached display easel which is extremely simple in its structure, and economical to manufacture and assemble.

A related object of the invention is to provide an improved combined post card mailer and easel as above set forth, which is light-weight so as to not introduce significant extra expense, as for example, added postage due to either overweight, or over-size physical characteristics.

Still another object of the invention is to provide an improved combined post card mailer and easel of the kind indicated, which can be readily mass produced at a minimum overall cost.

Still another object of the invention is to provide an improved combined post card mailer and easel as above characterized, which is especially eye-catching, thereby having overall appeal to the consumer and rendering the article highly saleable as a marketable item.

In accomplishing the above objects the invention provides as a new article of manufacture, a combination mailing post card and display easel comprising in combination, a die-cut blank having an easel portion, an address and message portion, and a display portion. The address and message portion is separably attached to the display portion; also, the easel portion is foldable over the display portion. The address and message portion is in turn, foldable over the folded easel portion, and means are provided for separably holding the address and message portion in such overlying position.

The arrangement is such that the consumer can purchase the post card in a flat, folded condition which largely resembles the configuration of a conventional post card when viewed from either the front or the rear, but which has provision for the recipient to tear off the message and address portion and retain the decorative display portion and attached easel portion. The latter in turn can be folded along pre-creased fold lines, to form a stand at the rear of the display portion. The recipient can thereby support the latter in an upright position on a desk or table, for subsequent viewing.

As an added advantage, the construction can be virtually 100% cardboard, with the exception of a plurality of small glue strips that are utilized for securement of several of the panels of the post card in assembled relation.

Other features and advantages will hereinafter appear.

BRIEF DESCRIPTION OF THE DRAWINGS

In the drawings, illustrating a preferred embodiment of the invention.

DESCRIPTION OF THE PREFERRED EMBODIMENT

Essentially the present invention embraces, as a new article of manufacture, a combined mailer/photo post card and display easel for the photo portion of the post card, such that the recipient, after receiving the card and reading its message, can display the card in a simple and straightforward manner, as a decorative or ornamental article of display on a table or desk.

In accomplishing the dual function, namely a mailer and display article, there is provided a die-cut blank of cardboard generally designated by the numeral 10, FIG. 1, which is so arranged to comprise three individual sections or portions, namely an address and message portion 12, a display portion 14, and an easel portion 16, the nature of these being described in more detail hereinbelow.

Figure 1:
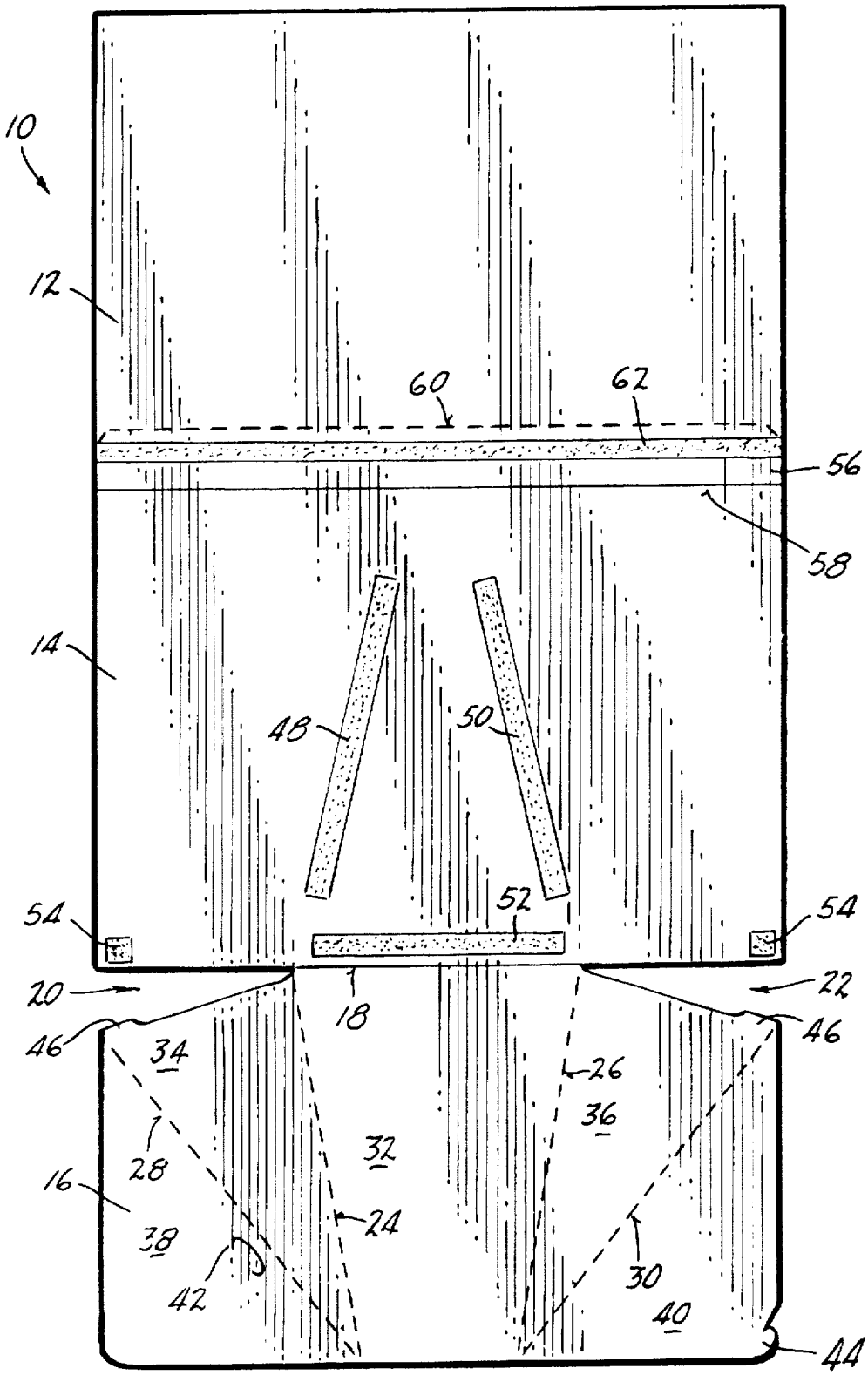
FIG. 1 is a plan view of a die-cut blank of cardboard as utilized in the fabrication of the combined post card and easel of the present invention. The blank comprises an easel portion, an address and message portion, and a display portion. The display portion has on one face, three elongate glue strips positioned in a triangular configuration.

FIG. 1 shows the initial form of the die-cut blank 10. As can be readily understood, a large number of such forms can be laid out on an expansive cardboard sheet, and a series of blanks formed simultaneously therefrom by blanking techniques that are, per se, known in the art.

In order to provide a glossy, high-contrast color picture on the display portion of each card, the sheet (not shown) from which the blanks are cut is first printed with the desired pictorial material at the locations corresponding respectively to the display portions 14 of the post cards. In FIG. 1, the color photo is impressed on the reverse of the rectangular panel constituting the display portion 14, for example.

By the invention, there is created a unique configuration involving the various portions of the blank 10, in order to provide the desired end-product when the blank 10 is folded and glued, and subsequently unfolded by the recipient, in accordance with the teachings of the present invention.

Referring now again to FIG. 1, the display portion 14 and easel portion 16 are integrally formed, with a fold line 18 that is preferably impressed or stamped at the time of the die-cutting. The cutting produces a pair of deep V-notches 20, 22 of generally triangular shape, the apices of each notch 20, 22 being at the opposite ends of the fold line 18, as shown.

Also, by the invention, the easel portion 16 is provided with additional die-cut fold lines indicated 24, 26, 28 and 30, which ultimately define the configuration of the folded easel panels to be described below. The easel portion 16 comprises a center or anchorage panel 32, a left-side panel 34, a right-side panel 36, an easel back under-panel 38, and an easel back over-panel 40. In addition, the easel portion 16 is provided with a semi-circular locking cut 42 in the easel back under-panel 38, constituting a retainer slit, and a locking tab formation 44 or, the easel back over-panel 40, which tab formation is receivable in the slit 42 when the easel is assembled. Adjacent the V-notches 20, 22 are two flat extensions, respectively on the left- and right-side panels 34, 36 respectively, each extension, constituting a foot 46 of the easel portion 16, such feet ultimately engaging the surface of the table or desk (not shown) when the post card/easel is assembled as a stand-alone unit.

Further by the invention, the display portion 14 is provided with a plurality of glue strips 48, 50 and 52, respectively, which are shown as being disposed in a generally triangular configuration and which are adapted to permanently secure the center or anchorage panel 32 of the easel portion 16 when the latter is folded onto the display portion 14. Additional glue patches or spots are provided on the display portion 14, indicated at 54, which due to the provision of the V-notches 54, are left exposed when the easel portion 16 is folded over the display portion 14, as in FIG. 2. By such an arrangement, the glue patches 54 remain accessible to secure the address and message portion 12, which is subsequently folded downwardly from the position of FIG. 1, to the position of FIG. 3.

Referring again to FIG. 1, by the invention there is provided a foldable strip 56 between the address and message portion 12, and the display portion 14, the strip 56 being defined by a fold line 58 and a die-cut tear line or line of weakness 60 that is generally parallel to, but spaced from the fold line 58. An additional, elongate glue strip 62 is provided on the foldable strip 56.

Figure 3:
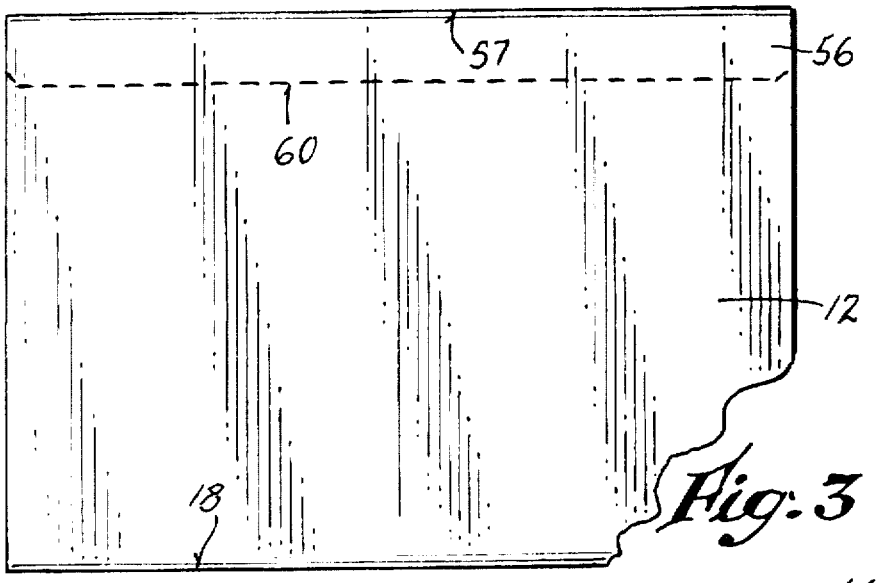
FIG. 3 is a plan view of the post card, wherein the message and address portion thereof has been folded downwardly over the superposed assembly of display portion and easel portion, and secured by a glue strip that is coextensive with a fold line which lies between the address and message portion, and the display portion.
Figure 2:
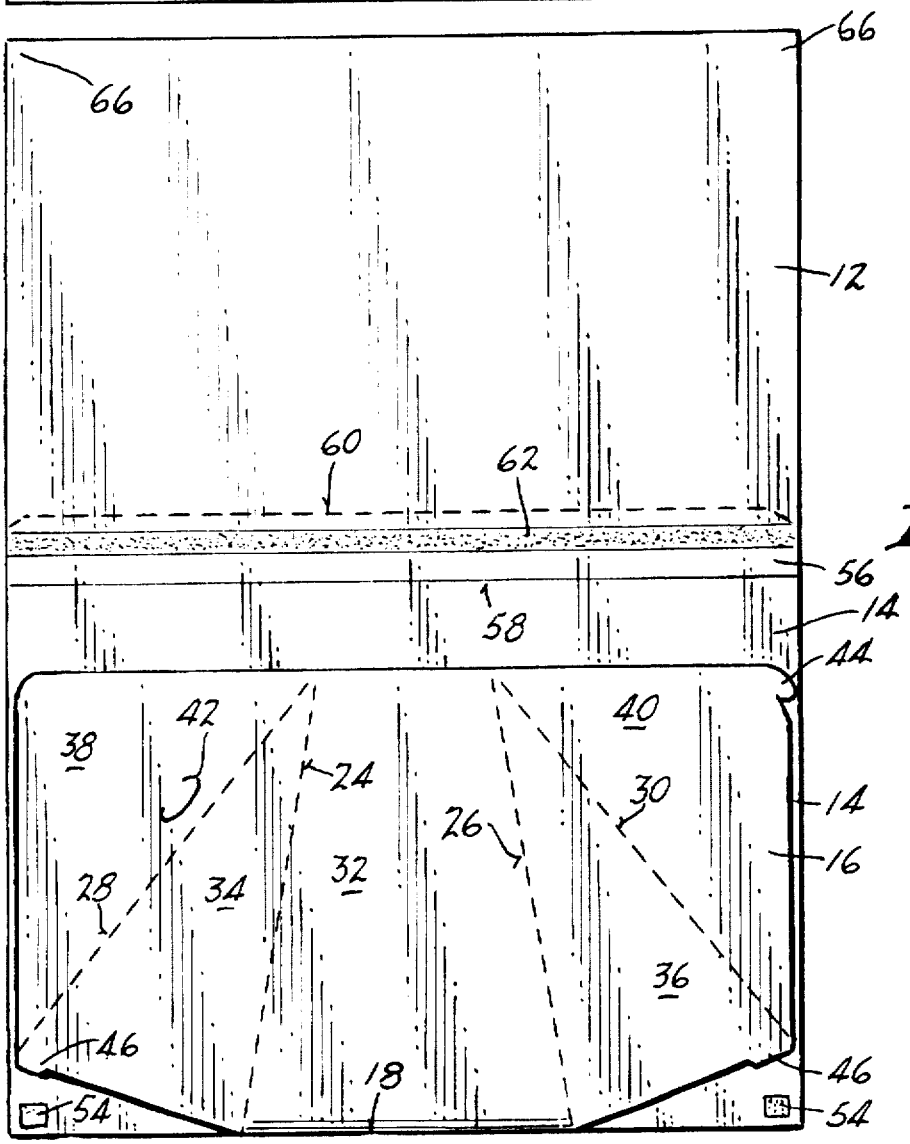
FIG. 2 is a plan view of the post card's easel portion having been folded upwardly over its display portion, and a central panel of the easel portion permanently affixed thereto by the triangularly-disposed glue strips of FIG. 1.
Figure 6:
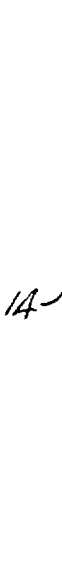
FIG. 6 is a side edge elevation of the card of FIG. 5.
Figure 5:
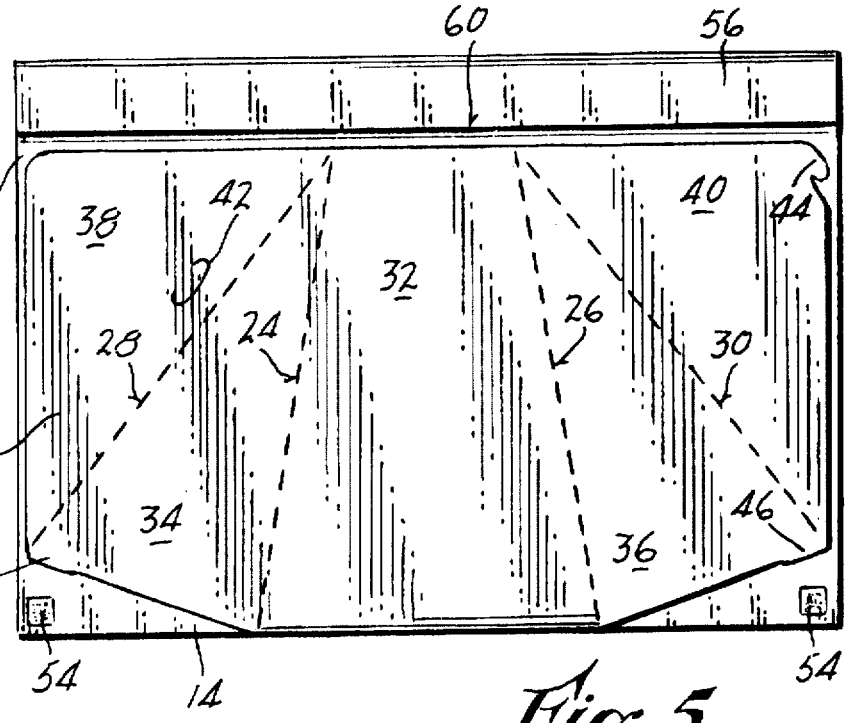
FIG. 5 is a rear elevation of the card, subsequent to the address and message portion having been removed or torn away by the recipient of the card, in readiness for assembling the easel portion thereof.

With such an arrangement the blank 10 of FIG. 1 can be folded and glued progressively according to the illustrations of FIGS. 2 and 3, so as to produce a finished picture post card which is ready for mailing. In particular, the assembly steps are briefly outlined in summary; with reference to FIGS. 1–3; first the easel portion 16 is folded upwardly along the fold line 18, and the anchorage panel 32 is pressed onto the glue strips 48, 50 and 52, which thereafter hold the entire easel portion 16 in flat, superposed relation with the display portion 14. The folded cardboard now has the configuration of FIG. 2. Thereafter, the address and message portion 12 is folded downwardly over the superposed easel portion 16 and display portion 14, along the fold line 58, to the position of FIGS. 3 and 4, the glue strip 62 adhering to the adjacent edge region of the display portion 14, and thereby functioning to retain the folded disposition of the address and message portion 12. The glue patches 54 also contact the opposite corners 66 of the upper edge area in FIG. 2, of the address and message portion 12, although along limited areas so as to permit separation of the address and message portion 12 from the display portion 14 at a later time, by the recipient of the post card.

Figure 4:
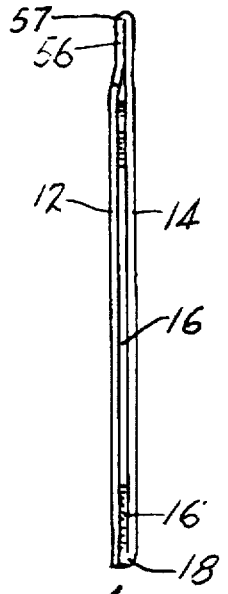
FIG. 4 is a right edge elevation of the card of FIG. 3.

The post card of FIGS. 3 and 4 is thus substantially flat, consisting of three superposed cardboard layers, namely the address and message portion 12 facing one side, the display portion 14 facing the opposite side, and the easel portion 16 sandwiched therebetween, so as to be normally hidden from view while the post card is being displayed at a store counter or stand.

Upon picking up the card, the purchaser can see the display portion having the photo on one side of the package, and the message/address portion on the opposite face of the package. After being suitably stamped and addressed, the package can be mailed to a friend or relative in the usual manner. It is to be noted that all of the glue strips 48, 50, 52 are intact, as are the two glue patches 54. The package thus resembles, in many respects, a conventional post card, though differing therefrom in that it consists of three layers, FIG. 4, and not a single layer.

Figure 8:
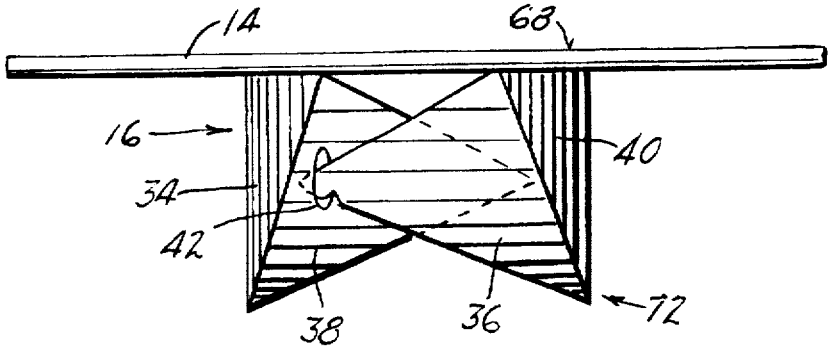
FIG. 8 is a top plan view of the assembled easel portion and display portion.

Referring now to FIGS. 3–6, when the post card is delivered to the recipient, he or she can immediately view the color photo appearing on the exposed side of the display portion 14, designated as a photo surface 68 in FIG. 8, and read the message on the exposed side of the address and message portion 12, as would be the case with a conventional post card.

In the past, following initial inspection the recipient of a conventional photo post card would usually either place it face down on a table or desk, or discard it. Frequently, however, the recipient was reluctant to merely discard the item, since some of the photos are truly picturesque and worthy of saving, so as to be able to show them to friends, family, or associates. As a consequence, often the card would be temporarily propped against a table weight or bowl, or in the case where multiple cards were being saved, they were often stacked as in bookcase fashion, and usually in such a way that little or none of the material on the card faces could be directly viewed.

In contrast, with the improved combined post card and display of the present invention, the recipient can tear off the address and message portion 12 at the die cut line, or line of weakness 60, thereby exposing the easel portion 16. By following printed instructions (not shown) that can be optionally be applied to one of the now-visible easel portion panels 32, for example, the recipient can readily unfold the panels 34, 36, 38 and 40 in FIG. 5 to thus form a three-dimensional stand for the card. Typically, such instructions would be visible only after the address and message portion 12 has been removed.

In assembly of the easel portion to form the stand, all panels formed by fold lines 24, 26, 28 and 30, FIG. 1, can be folded in directions away from the central or anchorage panel 32, and in the manner of FIGS. 7–10, to form a truncated pyramid. The central panel 32 remains glued to the display portion 14 during such folding.

In particular, the easel left side-panel 34 and easel right side-panel 36 are folded rearwardly at roughly 90 degrees, and the easel back under-panel 38 and easel back over-panel 40 each folded 90 degrees with respect to the easel side-panels 34 and 36. The locking tab 44 is thereafter nested in the locking slot 42, to retain the panels in assembled relation as shown in FIGS. 7–10.

Figure 7:
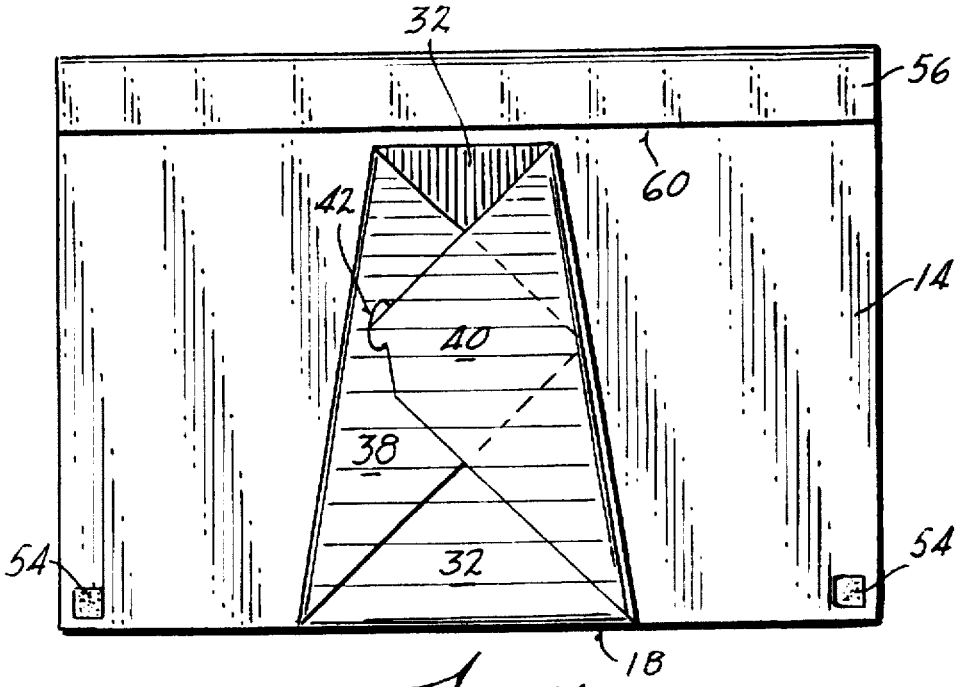
FIG. 7 is a rear elevation of the card of FIGS. 5 and 6, with the easel portion assembled, and with the display portion supported thereby. The decorative face of the display portion faces rearwardly in this view.
Figure 9:
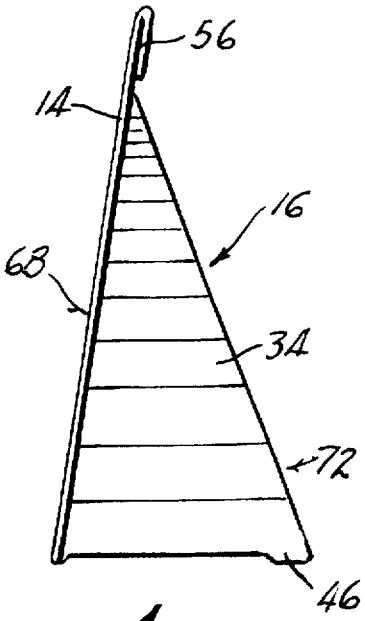
FIG. 9 is a side elevation of the easel portion and display portion of FIG. 8.

FIG. 9 illustrates the disposition of the feet 46 of the easel, with respect to the remainder of the easel and with respect to the display portion 14. In FIG. 9, the display portion comprising the colored photo would appear on the leftward-facing surface 68. In FIG. 7, the photo would appear on the surface opposite the viewer.

Improved stiffness and strength are provided by the foldable strip 56, which remains intact on the display portion 14. The upper edge 57 of the strip, FIGS. 3 and 4, being folded as opposed to torn, is smooth and aesthetically pleasing, giving the post card an attractive, finished appearance. The torn line of weakness 60 appears at the rear of the display portion 14, just above the top of the easel center panel in FIG. 7; this is mostly out of view, and thus is not considered objectionable.

The recipient thus has the added enjoyment of subsequent viewing of the card, as opposed to the usual disposition of conventional cards which are often viewed only twice, once at the time of receipt, and the second typically being at the time they are discarded.

The one-piece die-cut cardboard construction as provided by the invention is extremely simple from the manufacturing standpoint. Subsequent operations involving application of glue strips/patches are readily performed by automatic equipment that is known in the art. Folding is similarly accomplished with known automatic equipment, the result of which is an extremely economical production routine, involving minimum of handling and/or manual labor.

The stand is completely self-supporting, and no additional glues or adhesives of any type are involved in assembling the combined post card and easel.

A distinct advantage of the product of the invention is the integrity of the easel and display; at the time of purchase of the post card, the mechanism for supporting the card is already on board, and accompanies the card as it is being filled out and mailed; it remains in position for the recipient, until his initial inspection of the card is completed, and the card is to be either stored or disposed of.

The method of the invention involves basically the steps of forming an elongate blank 10 of cardboard, by die-cutting, FIG. 1, imparting two transverse fold lines 18 and 58 in the elongate blank so as to partition the blank into three portions, an address and message portion 12, a display portion 14, and an easel portion 16. Thereafter the easel portion 16 is folded over the display portion 14 along the one fold line 18, so as to overlie the display portion 14 and remain in superposed relation therewith. The method further embraces the step of folding the address and message portion 12 along the other fold line 58, so as to overlie the superposed easel portion 16 and display portion 14. Finally, the address and message portion 12 is secured to the display portion 14 by pressing it onto the glue spots 54. The resultant post card assembly, shown in FIGS. 3 and 4, thus consists essentially of a three layer package, with the easel portion 16 being sandwiched between, and largely concealed by, the address and message portion 12 and the display portion 14. One face of the assembly comprises a surface of the address and message portion 12, and the other face of the assembly comprises a surface of the display portion 14, as in FIG. 4.

In practice, the address and message portion has the foldable transverse strip 56 adjacent to and coextensive with the fold line 58. The strip 56 is adhered, as by the glue strip 62, to the display portion 14 after the address and message portion 12 is folded over the superposed easel portion 16 and display portion 14, to provide the assembly with the finished, folded edge 57, FIGS. 3 and 4, along the folded strip 56. There thus exists a double thickness of cardboard at the location of this folded edge. The address and message portion 12 is also secured to the display portion 14 by the adhesive patches 54, which contact the corners 66, FIG. 2, of the address and message portion 12 when the latter is folded.

Figure 10:
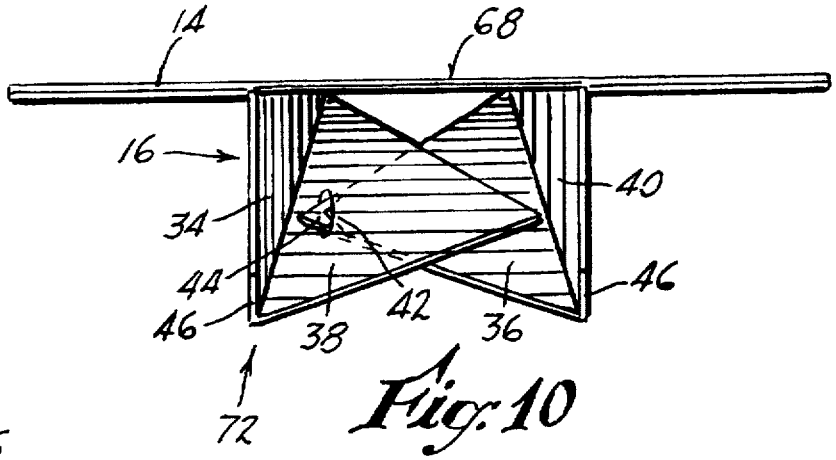
FIG. 10 is bottom plan view of the easel portion and display portion of FIGS. 8 and 9.

Following initial inspection of the post card, the recipient can lift the address and message portion 12 at the relatively weak areas represented by the glue patches 54 and tear it off at the line of weakness 60, as can be readily understood. The resulting post card thus comprises the display portion 14 and easel portion 16, and the latter can be readily folded to form a three-dimensional pyramid, constituting a support or stand for the display portion, as shown in FIGS. 8–10.

The line of weakness 60 is disposed at that face of the display portion which is attached to the easel portion. Thus, following the tearing off of the message and address portion, the resulting tear line is not visible from the front of the display portion, and thus, any tendency for a ragged edge to occur does not materially degrade the overall appearance of the display portion when it is being supported by the easel portion and viewed from the front.

From the above it can be seen that I have provided a novel and improved combination post card mailer and easel which are simple in structure and convenient to use. Due to the integral nature of the easel portion and display portion, the recipient is conveniently supplied with all that is required to convert the card into an unusual, attractive item of display or decoration, or as part of a collection of travel or personal mementos.

The disclosed invention is thus seen to represent a distinct advance and improvement in the field of display articles of the type that are adapted for postal or courier-type delivery.

Variations and modifications are possible without departing from the spirit of the invention.

Each and every one of the appended claims defines an aspect of the invention which is separate and distinct from all others, and accordingly it is intended that each claim be treated as such when examined in the light of the prior art devices in any determination of novelty or validity.

What is claimed is:

1. As a new article of manufacture, a flat mailing package consisting of a combined mailing post card and display easel, said package comprising in combination:

a) a die-cut blank having an easel portion, an address and message portion, and a display portion, b) said address and message portion being separably attached to said display portion, c) said easel portion having means including at least two mutually divergent fold lines to enable it to be folded in to angularly related panels independently of the display and address and message portions, and being folded over said display portion, said easel portion lying flat thereagainst in superposed relation therewith, d) said address and message portion being folded over said superposed folded easel portion and display portion, said address and message portion lying flat against the latter two portions, and e) means for separably holding said address and message portion in folded position over said easel portion.

2. The new article of manufacture as set forth in claim 1, wherein:

a) the display portion includes a foldable strip extending along said address and message portion, and b) a fold line coextensive with said foldable strip, enabling the latter to be folded over part of the remainder of the display portion.

3. The new article of manufacture as set forth in claim 2, wherein:

a) adhesive means are provided to hold the said foldable strip folded against the said display portion of the article.

4. The new article of manufacture as set forth in claim 3, wherein:

a) said adhesive means which holds the foldable strip comprises an adhesive strip extending coextensive with the foldable strip.

5. The new article of manufacture as set forth in claim 2, wherein said folded strip, when folded over the said part of the remainder of the display portion, presents a finished and smooth, folded edge configuration at the top of the display portion.

6. The new article of manufacture as set forth in claim 5, wherein said folded edge configuration comprises a double thickness of cardboard.

7. The new article of manufacture as set forth in claim 2, wherein:

a) the foldable strip is elongate, and wherein the folded strip and the address and message portion meet at a line of weakness, constituting a tear line, b) said line of weakness being disposed along one edge portion of the folded strip, said one edge portion being spaced a finite distance from the adjacent edge of the display portion, such that when the address and message portion is separated from the folded strip and display portion at the tear line, the latter is disposed at solely one face of the display portion.

8. The new article of manufacture as set forth in claim 7, wherein said tear line is disposed at that face of the display portion to which the easel portion is secured, whereby the tear line is concealed from view when the display portion is viewed from the opposite face thereof.

9. The new article of manufacture as set forth in claim 1, wherein:

a) adhesive means are provided to hold the said easel portion to the display portion of the article.

10. The new article of manufacture as set forth in claim 9, wherein:

a) the said easel portion has an anchorage panel, b) said adhesive means comprising glue strips between the anchorage panel and said display portion.

11. The new article of manufacture as set forth in claim 10, wherein:

a) the anchorage panel of the easel portion is roughly triangular, b) said glue strips being disposed in an angular configuration along peripheral portions of the anchorage panel.

12. The new article of manufacture as set forth in claim 1, wherein:

a) the means for separably holding the address and message portion folded over the said easel portion comprises adhesive spots on the said display portion.

13. The new article of manufacture as set forth in claim 1, wherein:

a) said easel portion comprises five panels, b) one of said panels comprising an anchorage panel to secure the easel portion to the display portion.

14. The new article of manufacture as set forth in claim 13, wherein:

a) said anchorage panel is disposed between the remaining four panels, b) said remaining four panels being located two on each side of the anchorage panel.

15. The new article of manufacture as set forth in claim 1, wherein:

a) the die-cut blank has deep V-notches between the display portion and the easel portion, b) corresponding edges of said V-notches constituting opposite bottom edges of the easel portion when the easel is set up.

16. A method of manufacturing a flat mailing package consisting of a combined post card and attached display easel, comprising the steps of:

a) forming an elongate blank of cardboard, by die-cutting, b) imparting two transverse fold lines in said elongate blank, so as to divide the blank into three portions, an address and message portion, a display portion, and an easel portion, c) folding the easel portion over the display portion along one of said fold lines so as to overlie the display portion and lie flat in superposed relation therewith, d) folding the address and message portion along the other of said fold lines, to as to overlie and be flat against the superposed easel portion and display portion, and e) securing the address and message portion to one of said other portions, so as to form a substantially flat multi-layer post card assembly, one face of said assembly comprising a surface of the address and message portion, and the other face of the assembly comprising a surface of the display portion.

17. The method of claim 16, wherein the address and message portion is secured to the display portion, by means of adhesive.

18. The method of claim 16, wherein the easel portion is secured to the display portion by means of adhesive.

19. The method of claim 16, and including the further step of imparting to the easel portion, a series of fold lines which enable the easel portion to be folded along said lines to form individual panels.

20. The method of claim 16, wherein the address and message portion has a foldable transverse strip adjacent to and coextensive with said other fold line, and including the further step of adhering the foldable strip to the display portion after the address and message portion is folded, over the superposed easel portion and display portion, to provide the assembly with a finished, folded edge at the location of the folded strip.

21. The method of claim 16, wherein the easel portion has a series of fold lines and the address and message portion has a transverse line of weakness adjacent said other fold line, and including the further step of:

a) tearing the address and message portion from the display portion at said transverse line of weakness, so as to expose the underlying easel portion, and b) folding the easel portion along the fold lines thereof, to form a three-dimensional easel, attached to the display portion.

22. The method of claim 16, wherein the easel portion is sandwiched between the display portion on the one hand, and the address and message portion on the other hand, in the said post card assembly.

23. The method of claim 16, wherein the easel portion is largely concealed by virtue of its being disposed between the display portion and the address and message portion of the post card assembly.

24. As a new article of manufacture, an easel construction for a display card, comprising in combination:

a) an anchorage panel to engage and support the display card, b) a left-side panel connected with said anchorage panel, and extending transversely thereof in a direction away from the display card, c) a right-side panel connected with said anchorage panel, and extending transversely thereof in a direction away from the display card, d) a back under-panel connected to one of said side panels, and extending toward the other of said side panels, e) a back over-panel connected to the other of said side panels, and extending toward the said one side panel, f) said back over-panel having a projecting tab, and the back under-panel having a slot to receive the tab, said over-panel being disposed in close overlapping relation to said under-panel such that portions of the latter lie between the over-panel and the said anchorage panel of the easel , said over-panel and said under-panel being disposed angularly with respect to the anchorage panel.

25. The easel construction as set forth in claim 24, wherein said anchorage panel, said side panels, and said under-panel and over-panel are all integrally formed with one another.

26. The easel construction as set forth in claim 24, wherein the anchorage panel has substantially the configuration of a trapezoid.

27. The easel construction as set forth in claim 24, wherein said side panels each have a substantially triangular configuration.

28. The easel construction as set forth in claim 24, wherein the back under-panel and the back-over panel each have a substantially triangular configuration.

29. The easel construction as set forth in claim 24, wherein the anchorage panel is integrally formed with the display card along a fold line.

30. As a new article of manufacture, a combination mailing post card and display easel comprising, in combination:

a) a die-cut blank having an easel portion, an address and message portion, and a display portion, b) said address and message portion being separably attached to said display portion, c) said easel portion being foldable over said display portion, d) said address and message portion being foldable over said folded easel portion, and e) means for separably holding said address and message portion in folded position over said easel portion, f) the said easel portion comprising five panels, g) one of said panels comprising an anchorage panel to secure the easel portion to the display portion, h) the said anchorage panel being disposed centrally of the remaining four panels, i) said remaining four panels being located two on each side of the anchorage panel, j) the panel on one side of the anchorage panel having a locking tab, and the panel on the other side of the anchorage panel having a locking cut in which the said locking tab can be received.

31. As a new article of manufacture, a combination mailing post card and display easel comprising, in combination:

a) a die-cut blank having an easel portion, an address and message portion, and a display portion, b) said address and message portion being separably attached to said display portion, c) said easel portion being foldable over said display portion, d) said address and message portion being foldable over said folded easel portion, and e) means for separably holding said address and message portion in folded position over said easel portion, f) the die-cut blank having deep V-notches between the display portion and the easel portion, g) corresponding edges of said V-notches constituting opposite bottom edges of the easel portion when the easel is set up, h) said corresponding edges of the V-notches having foot configurations which are located adjacent the side edges of the die-cut blank.

* * * * *